United States Patent [19]

Rudolph et al.

[11] 4,040,800

[45] Aug. 9, 1977

[54] REACTOR FOR GASIFYING SOLID FUELS, PARTICULARLY COAL, UNDER SUPERATMOSPHERIC PRESSURE

[75] Inventors: Paul Rudolph, Bad Homburg; Herbert Bierbach, Frankfurt am Main; Hans Küpfer, Frankfurt am Main; Carl Hafke, Frankfurt am Main; Rudolf Kohlen, Wehrheim, all of Germany

[73] Assignee: Metallgesellschaft Aktiengesellschaft, Frankfurt am Main, Germany

[21] Appl. No.: 715,077

[22] Filed: Aug. 17, 1976

[30] Foreign Application Priority Data

Feb. 26, 1976 Germany ..... 2607742

[51] Int. Cl.[2] ..... C10J 3/30; C10J 3/32

[52] U.S. Cl. ..... 48/85.2; 48/73; 48/86 R; 110/37; 241/245

[58] Field of Search ..... 48/85.2, 63, 73, 86 R, 48/99, 67, 76; 110/37, 108; 202/251, 262; 241/245; 214/17 B, 17 C; 222/194, 410

[56] References Cited

U.S. PATENT DOCUMENTS

| | | | |
|---|---|---|---|
| 2,667,409 | 1/1954 | Hubmann | 48/63 |
| 3,951,616 | 4/1976 | Rudolph | 48/86 R |

*Primary Examiner*—Robert L. Lindsay, Jr.
*Assistant Examiner*—George C. Yeung
*Attorney, Agent, or Firm*—Burgess, Dinklage & Sprung

[57] ABSTRACT

An apparatus for gasifying solid fuels such as coal, in a packed bed by a treatment with a gasifying agent such as free oxygen-containing gas and water vapor under pressure, comprising a water-cooled reactor housing provided in its lower portion with gasifying agent inlet openings, a fuel distributor mounted on a vertical axis, a stirrer on a shaft disposed in the fuel bed in the upper portion of the reactor, and independent first and second drive means for independently rotating the fuel distributor and stirrer. Advantageously the distributor includes a hollow bearing shaft coaxial with the shaft of the stirrer and the stirrer shaft also has a bearing, a common bearing support cooperating with both of the bearings.

3 Claims, 1 Drawing Figure

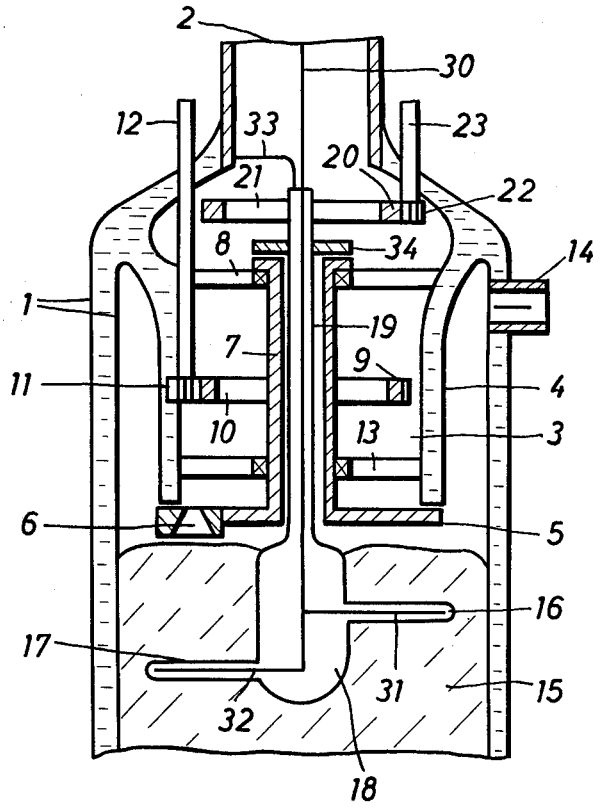
2
30
12
33
23
20
21
22
8
34
14
1
19
7
9
11
4
10
13
3
6
5
16
17
31
15
32
18

REACTOR FOR GASIFYING SOLID FUELS, PARTICULARLY COAL, UNDER SUPERATMOSPHERIC PRESSURE

BACKGROUND

This invention relates to a reactor for gasifying solid fuels, particularly coal, in a packed bed by a treatment with gasifying agents comprising free oxygen-containing gases and water vapor, under a pressure of 5–100 bars, comprising a water-cooled reactor housing, a fuel distributor which is rotatable on a vertical axis, a rotatable stirrer, which is disposed in the fuel bed in the upper portion of the reactor, and gasifying agent inlet openings in the lower portions of the reactor.

Reactors for the pressure gasification of solid fuels, such as coal, brown coal or also peat are already known. Details of these pressure reactors are explained in Printed German Application 1,021,116 and German Patent 2,352,900 and U.S. Pat. Nos. 2,667,409; 3,930,811; 3,902,872; and 3,937,620, the disclosures of which are incorporated herein by reference. In the known reactor and in the reactor according the invention, granular fuel forming a packed bed descends under gravity and is contacted and reacted with gasifying agents flowing in a countercurrent. In addition to water vapor and oxygen, the gasifying agents may comprise oxygen-containing or oxygen-releasing gases, such as air or carbon dioxide.

Efforts are being made to provide reactors for the pressure gasification of fuels at progressively increasing throughput rates and to enable the gasification also of caking and swelling coals. In known reactors these efforts have been obstructed by difficulties due to a nonuniform gasification behavior. It is an object of the invention to eliminate the difficulties which have arisen in the state of the art and to ensure a uniform gasification also of caking and swelling coals. In a reactor of the kind defined herein above this is accomplished according to the invention in that the stirrer and distributor are adapted to be rotated independently of each other by first and second drive means, respectively.

In the previously known reactors, the stirrer and the distributor are rigidly interconnected. In view of the requirements previously to be met in connection with the pressure gasification of solid fuels, this arrangement has given quite satisfactory results. Surprisingly it has been found, however, that the elimination of the coupling between the distributor and stirrer permits a more flexible operation under adjustable conditions and that this is sufficient to preclude certain troubles which arise in known reactors. In view of the state of the art it was unexpected that the measures adopted according to the invention would result in substantial improvement.

An embodiment of the pressure gasification reactor will be explained by way of example with reference to the drawing, which is a diagrammatic longitudinal sectional view showing the upper portion of a reactor in accordance with the invention.

Referring now more particularly to the drawing, the reactor serves for a gasification of solid fuels under a pressure of about 5–100 bars, preferably about 10–80 bars, and comprises a water-cooled jacket 1. Fuel to be gasified is charged from above through a pressure-equalizing lock chamber, not shown, and a fuel shaft 2 into a distributing chamber 3. The side walls of the distributor chamber are formed by a rigid cylindrical wall 4, which is water-cooled. The fuel is carried by a rotatable distributing disc 5, which has at least one outlet opening 6. There is no connection between the wall 4 and the disc 5. The distributor includes the rotatable distributing disc 5 as well as a vertical hollow bearing shaft 7, which depends from bearing brackets 8 secured to the cylindrical wall 4 and bears on the upper surface of said brackets. A gear rim 9 is connected to the bearing shaft 7 by spokes 10 and is in mesh with a pinion 11, which is rotated by an electric motor, not shown, and a drive shaft 12. The bearing shaft 7 of the distributor is additionally supported at its lower end by bearing struts 13.

The granular solids flowing from the outlet 6 of the distributor into the bed 15 of fuel to be gasified are moved by rotating stirrer arms 16 and 17, which prevent a caking of the and disintegrate any caked coal particles. Product gas produced by the gasification leaves the reactor through the outlet 14. The stirrer arms belong to a stirrer, which comprises also a central member 18, a hollow shaft 19 joined to the central member 18, and a gear rim 20 provided with spokes 21. The stirrer is driven by a pinion 22, which is in mesh with the gear rim 20 and provided with a drive shaft 23. The latter is connected to an infinitely variable electric motor by means which are not shown. Because separate drives are provided, the speed and the sense of rotation of the stirrer can be controlled independently of the movement of the fuel distributor. Advantageously the hollow bearing shaft 7 is coaxial with the shaft of the stirrer. The bearing brackets 8 is the common bearing support cooperating with the bearings of the distributor and of the stirrer shaft.

The stirrer is cooled by cooling water, which flows in conduits 30, 31, 32 and is returned through the hollow interior of the stirrer and transferred through conduit 33 into the cooling jacket of the reactor. A bearing plate 34 connected to the shaft 19 serves to support the stirrer on the bearing shaft 7 of the fuel distributor. This is enabled by the fact that both the distributor and the stirrer rotate only at a relatively low speed in operation. In most cases the fuel distributor may be driven at an adjustable speed of about 1–10 revolutions per hour and the stirrer may usually be rotated at speeds of about 1–30 revolutions per hour.

It will be appreciated that the instant specification and examples are set forth by way of illustration and not limitation, and that various modifications and changes may be made without departing from the spirit and scope of the present invention.

What is claimed is:

1. An apparatus for gasifying solid fuels in a packed bed by a treatment with a free oxygen-containing gas and water vapor under pressure, comprising a water-cooled reactor housing provided in its lower portion with gasifying agent inlet openings, a fuel distributor mounted on a vertical hollow bearing shaft in the upper portion of the reactor, a rotatable distributing disc attached to the lower end of said bearing shaft, a stirrer mounted on a stirrer shaft, said stirrer being disposed in the fuel bed in the upper portion of the reactor, and independent first and second drive means for independently rotating the fuel distributor and stirrer.

2. An apparatus according to claim 1, wherein the hollow bearing shaft is coaxial with the shaft of the stirrer.

3. An apparatus according to claim 2, including a further bearing on the shaft of the stirrer, and a common bearing support cooperating with the bearings of the distributor and of the stirrer shaft.

* * * * *